United States Patent [19]

Pfleiderer

[11] Patent Number: 4,821,330

[45] Date of Patent: Apr. 11, 1989

[54] WIDE-BAND LOUDSPEAKER HAVING A DIAPHRAGM AREA DIVIDED INTO SUB-AREAS FOR VARIOUS FREQUENCY RANGES

[75] Inventor: Peter Pfleiderer, Erhardstrabe 9, D-8000 München 5, Fed. Rep. of Germany

[73] Assignee: Peter Pfleiderer, Munich, Fed. Rep. of Germany

[21] Appl. No.: 6,014

[22] Filed: Jan. 22, 1987

[30] Foreign Application Priority Data

Feb. 5, 1986 [DE] Fed. Rep. of Germany ..... 3603537

[51] Int. Cl.[4] ..... H04R 1/24; H04R 7/16

[52] U.S. Cl. ..... 381/184; 381/162; 381/194; 381/182

[58] Field of Search ..... 381/162, 182, 184–186, 381/192, 194

[56] References Cited

U.S. PATENT DOCUMENTS

| | | | |
|---|---|---|---|
| 2,539,672 | 1/1951 | Olson et al. | 381/184 |
| 3,114,429 | 12/1963 | Miner | 381/186 |
| 3,772,466 | 11/1973 | Hossbach | 381/184 |
| 4,190,746 | 2/1980 | Harwood et al. | 381/194 |
| 4,387,275 | 6/1983 | Shimada et al. | 381/162 |
| 4,547,631 | 10/1985 | Nieuwendijk et al. | 381/162 |
| 4,590,333 | 5/1986 | Strohbeen | 381/182 |
| 4,706,295 | 11/1987 | Putnam et al. | 381/184 |

*Primary Examiner*—John W. Caldwell, Sr.
*Assistant Examiner*—Tyrone Queen
*Attorney, Agent, or Firm*—Kane, Dalsimer, Sullivan, Kurucz, Levy, Eisele and Richard

[57] ABSTRACT

The invention relates to a wide-band loudspeaker in which the overall diaphragm is divided into an inner and an outer diaphragm sub-area. The inner diaphragm sub-area preferably consists of a dome-shaped cover of the moving-coil support. The outer diaphragm sub-area can be formed as a cone or NAWI diaphragm or as a shaped or moulded body, the shaped body having an at least approximately planar front face and its rear boundary face having the form of a cone or NAWI diaphragm. The outer diaphragm sub-area is connected to the moving-coil support by a frequency-dependent yieldable connection with high damping which at high audiofrequencies practically decouples the outer diaphragm sub-area from the moving-coil support but at low audiofrequencies acts like a rigid connection.

9 Claims, 8 Drawing Sheets

M = LARGE
Q = LARGE
N = SMALL

M = MEDIUM
Q = MEDIUM
N = MEDIUM

M = SMALL
Q = SMALL
N = LARGE

M = LARGE
Q = LARGE
N = SMALL

M = LARGE
Q = LARGE
N = SMALL

Fig. 7a
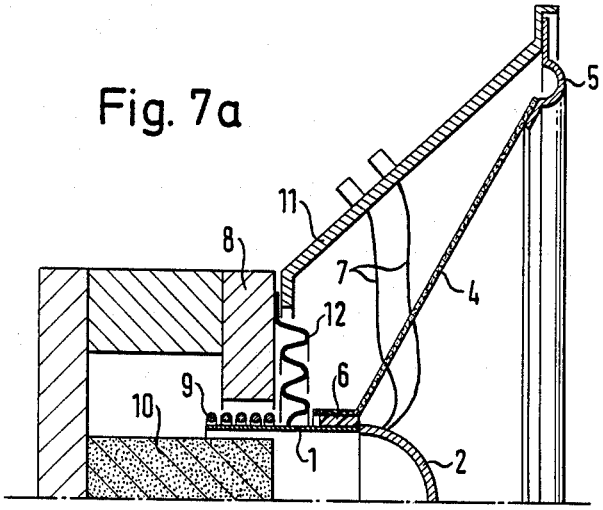
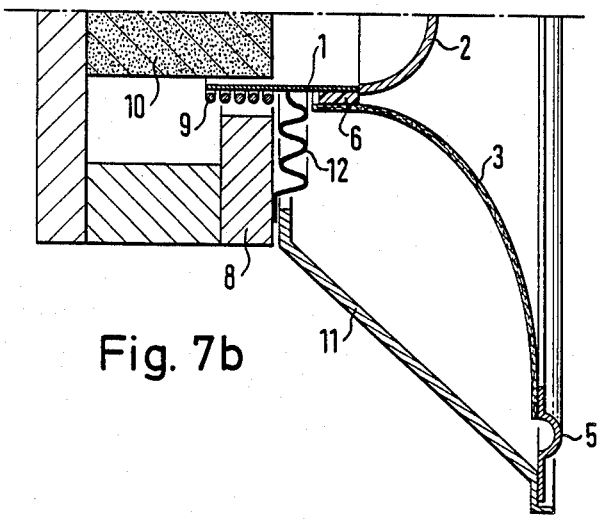
Fig. 7b

Fig. 7c
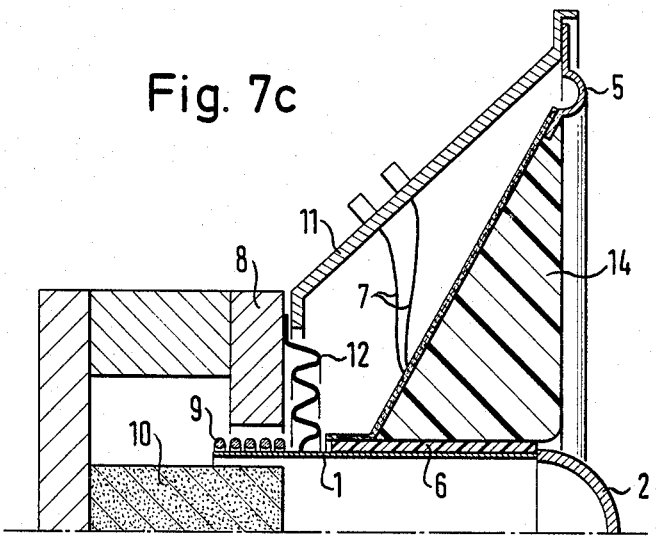
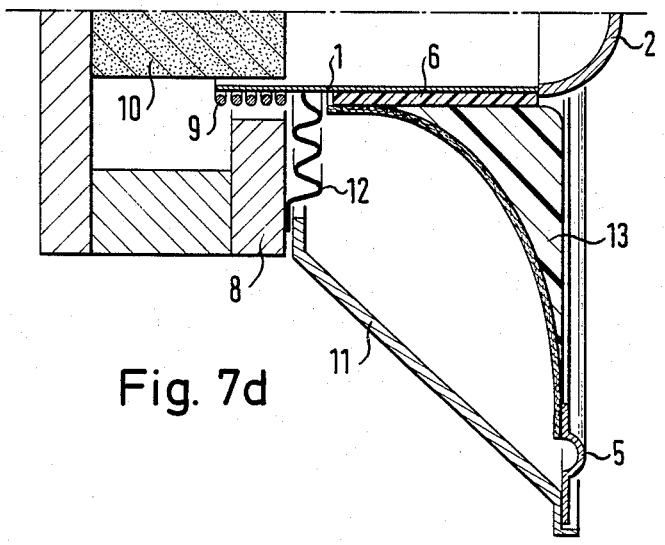
Fig. 7d

M = 0
Q = 0
N = SMALL

M = SMALL
Q = SMALL
N = LARGE

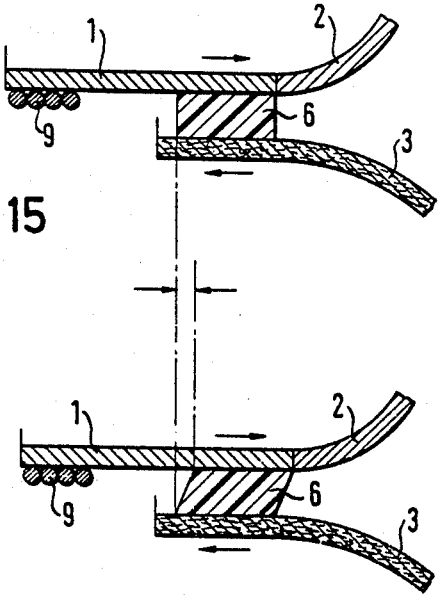
Fig. 15
Fig.16a
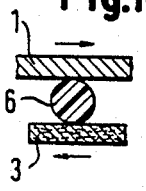
Fig.16b
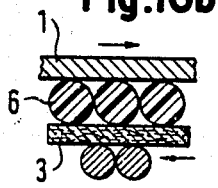
Fig.16c
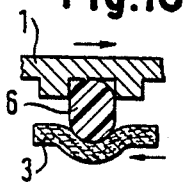
Fig.16d
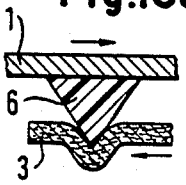
Fig. 16e
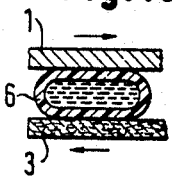
Fig.16f
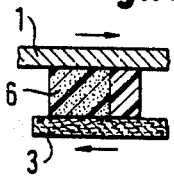
Fig.16g
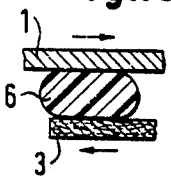
Fig.16h
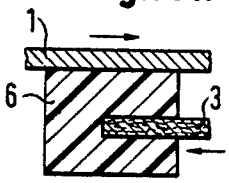
Fig. 16i
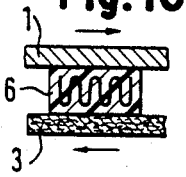
Fig.16 j
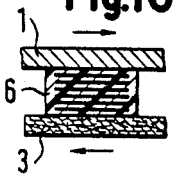

WIDE-BAND LOUDSPEAKER HAVING A DIAPHRAGM AREA DIVIDED INTO SUB-AREAS FOR VARIOUS FREQUENCY RANGES

All electrodynamic loudspeakers are mechanical oscillating systems which are characterized by intrinsic values such as spring constants, mass and damping and the diaphragms of which are stimulated to forced oscillations by the current of an amplifier, for example with the aid of a moving coil.

The fundamental defects resulting from this design principle of the electrodynamic transducer as regards amplitude and phase frequency response can be prevented with the method and circuit arrangement for distortion correction of electrodynamic, in particular electroacoustic, transducers according to DE- C-3,418,047.

Whereas the distortion correction or equalization with multipath loudspeakers in the low-frequency, medium-frequency and high-frequency range gives results which are excellent when measured and also on subjective perception, in wideband loudspeakers in the high-frequency or treble range because of the size of the diaphragm area necessary for the low-frequency or bass radiation undesirable directional effects occur in the sound radiation and in addition the reproduction quality is impaired by a high proportion of distortions.

Particularly unfavourable for a wide-band sound radiation are the planar flat diaphragm discs in which the force introduction takes place perpendicularly to the diaphragm surface (FIG. 1a). In this case, apart from the fundamental oscillations introduced by the moving coil the nature of the force introduction simultaneously produces flexural oscillations whose energy distributes itself substantially throughout the entire diaphragm area and alongside the fundamental oscillation always adds interfering sounds to the total sound radiation. The normal force stressing of planar diaphragms is usually very small (FIGS. 1b, 1c).

If the planar flat wide-band diaphragm is light and stiff, for example constructed as honeycomb or foamed material disc, the already mentioned pronounced directional effect for high frequencies results. In addition, high-frequency flexural oscillations occur not only with high-frequency fundamental oscillations throughout the entire diaphragm area but also arise with low-frequency fundamental oscillations and falsify the sound by interferences.

However, even if the planar flat wide-band diaphragm is made "soft" (viscoelastic), for example according to DE-C-2,123,098, on low-frequency stimulation in the centre of the diaphragm high-frequency flexural waves are propagated up to the edge clamping and for example back again from the latter and even with high-frequency stimulation in the centre the flexural waves cannot be restricted to the centre alone. They distribute themselves, in particular at high levels with relatively large moving-coil deflections, over a larger area in the soft diaphragm so that in this case as well there is always a possibility of an acoustic directional effect which is furthermore dependent on the level. With so-called "soft" diaphragms for wide-band transmission systems there is the additional disadvantage that practically no low bass frequencies can be transmitted. For an effective low bass very large moving-coil deflections would have to take place which apart from increased mechanical distortions would again result in uncontrolled diaphragm flexural oscillations.

With the paper or board diaphragms which are the most widespread in practice today, due to the three-dimensional conical dish form on dynamic oscillation load the flexural moment stress becomes smaller but the normal force stress increases (FIGS. 2*a, b, c*). In the likewise known three-dimensional arched so-called NAWI diaphragms this tendency is further magnified so that the flexural moment stress becomes still smaller and the normal force stress still greater (FIGS. 3*a, b, c*). The term NAWI is used to describe a membrane surface which cannot be unrolled into a two dimensional plane, such as a cone. Nevertheless, here as in all known wide-band loudspeakers the total diaphragm weight with the large air cushion in front opposes the diaphragm movement as inertia mass because at all frequencies the total diaphragm area must be stimulated to oscillate. If the diaphragm is light and stiff enough to permit bass response without excessive deformations this always leads at higher frequencies to the total area oscillating in parts at a multiple of the stimulating wavelength. With high frequencies partial oscillations (flexural oscillations) then arise on the entire diaphragm area with the disadvantage of interferences and the directional effect. The known wide-band loudspeakers with planar diaphragm form (according to FIG. 1*a*) and conical diaphragm form (according to FIG. 2*a*) are even worse in this respect than those with NAWI diaphragm form according to FIG. 3*a*. For the aforementioned diaphragm types the sound pressure distribution over the diaphragm surface is illustrated in FIG. 9 for bass, medium frequencies and treble along with the partial oscillations.

Since in the known wide-band loudspeakers according to FIG. 2*a* and FIG. 3*a* the transition from the thin diaphragm to the likewise thin moving-coil support is fixed and rigid, on dynamc stress flexural moments (partial oscillations) are always conducted to the moving-coil support and the dome or calotte mounted above the moving coil. The flexural oscillations conducted to the moving-coil support distort even the incipient mechanical diaphragm fundamental oscillation which in turn is itself superimposed by partial oscillations additionally arising in the diaphragm surface. The overall result is a high proportion of technical distortions in the transmission signal.

It is known in the art to distribute the sound radiation of the various frequency ranges with the aid of frequency-dividing networks amongst diaphragm areas of different sizes to avoid the directional effect in the particular frequency range. The individual systems for specific frequency ranges are moreover optimized as regards weight and stiffness so that the partial oscillations also remain small with respect to the excitation frequency. Such individual systems for the bass, medium and treble range have due to the edge clamping always a certain free displaceability with a corresponding travel limitation which in the treble range permits small diaphragm deflections, in the medium-frequency range larger deflections and still larger deflections for the bass range.

It is further known from DE-A-2,751,700 or DE-C-2,927,848 to divide a plane or slightly arched sheet diaphragm having only one moving-coil drive into a plurality of concentric diaphragm sub-areas for the various frequency ranges. It is however not possible to overcome in this manner the aforementioned acoustic and technical disadvantages.

If frequency mixtures are transmitted the high-frequency flexural oscillations of the large-area edge zone superimpose themselves on the high-frequency fundamental oscillations of the small centre and result in interferences. Even if the flexural moments in the outer edge zone are kept small by constructional measures in planar flat membranes they cannot be prevented. By the large radiation area a considerable sound level is reached and once again the acoustical directional effect arises in the high-frequency radiation and a high proportion of technical distortions results in the transmitted signal. The flatter a membrane is made the stiffer it must be. When it is made flat with articulations it becomes unstable. In the outer edge portion of the stiff disc mounted at the inside and outside on springs on dynamic stress tilt oscillations therefore also occur and result in additional uncontrollable sound mutilations and distortions (FIGS. 4*a, b*).

If damping members are located centrally at the individual discs in the manner proposed in DE-C-2,927,848 the force introduction at the edge of the disc results in a further increase in the tilt tendency (FIGS. 5*a, b*). If, as proposed in the same application, for small deflections for example in the treble range a free mobility is allowed terminating after a certain travel, shock stresses result within the movement when larger deflections occur (cf. FIG. 4 of DE-C-2,927,848).

Nor is it possible to obtain the desired effect even with a loudspeaker system in which as in European application No. 0 039 740 the cardboard cone is movably connected to the moving coil even for low frequencies and the drive of the diaphragm is effected substantially over an air cushion which is disposed above the moving-coil cover. This is only able to prevent high-frequency radiation for example in a bass loudspeaker but is fundamentally not a wide-band transmission system.

The invention is based on the problem of providing a wide-band transmission system which in the low-frequency or bass range oscillates substantially without flexural oscillations in piston manner as a whole and in the high-frequency or treble range oscillates substantially only over the centre of the calotte-shaped or dome moving-coil cover whilst simultaneously reducing the partial oscillations in the outer diaphragm part, the dome and in the moving-coil support.

Such a loudspeaker system no longer requires a frequency-dividing network which itself frequently generates mutilations of the electrical signal.

Whereas in multipath systems in multipath loudspeaker boxes sound discolourings result because due to the spatial separation of the individual loudspeakers when the listener changes his position different angles result, in particular in the vertical direction, for the superimposition of the treble frequencies with the bass frequencies, the wide-band loudspeaker according to the invention gives a sound impression independent of the position of the listener with respect to the loudspeaker.

The connection according to the invention of the moving-coil support provided with a dome-shaped cover to the outer diaphragm part acts like a joint which at high frequencies permits small mutual displacements (FIG. 8*a*) but at low frequencies is practically rigid (FIG. 8*c*). At medium frequencies there is a frequency-dependent gradual transition between the two extreme values.

As a result, at high frequencies only the small centre of the total diaphragm area, the dome, radiates sound without the disadvantage of the acoustic directional effect and the outer diaphragm part does not oscillate. At low frequencies the entire diaphragm comprising inner and outer parts oscillates in piston manner.

With the aid of the proposed connection between the moving-coil support and the outer diaphragm part formed as cone or NAWI diaphragm, in the entire frequency range to be transmitted not only the transmission of flexural moments generating partial oscillations from the outer diaphragm region to the moving-coil support and into the dome is avoided but also their formation in the first place. This gives a very considerable reduction of distortions in reproduction in electrodynamic wide-band loudspeakers.

It should also be mentioned that the wide-band loudspeaker according to the invention can easily be made with the aid of all conventional production apparatuses.

The advantages of the loudspeaker correction according to DE-C-3,418,047 also manifest themselves in conjunction with the mass system of the wide-band loud-speaker according to the invention effective in accordance with the frequency.

Hereinafter the invention will be described in detail with reference to a concrete example of embodiment of a wide-band loudspeaker with the aid of schematic drawings, wherein:

FIG. 1*a* shows the schematic structure of a known flat diaphragm transducer,

FIG. 1*b* shows the static system and the load,

FIG. 1*c* shows the stress type.

FIG. 2*a* shows the schematic structure of a known transducer with conical diaphragm, FIG. 2*b* shows the static system and the load, FIG. 2*c* shows the stress type.

FIG. 3*a* shows the schematic structure of a known transducer with NAWI diaphragm, FIG. 3*b* shows the static system and the load, FIG. 3*c* shows the stress type.

FIG. 4*a* shows the wide-band loudspeaker according to DE-A-2,751,700,

FIG. 4*b* shows the static system, the load, the deformation and the stress type.

FIG. 7*a* shows the schematic structure of the wide-band loud-speaker according to the invention with cone diaphragm, FIG. 7*b* shows the schematic structure of the wide-band loudspeaker according to the invention with NAWI diaphragm, FIG. 7*c* shows the schematic structure of the wide-band loudspeaker according to the invention with conical shaped, moulded or formed part, FIG. 7*d* shows the schematic structure of the wide-band loudspeaker according to the invention with a shaped element the rear limiting face of which is shaped like a NAWI membrane.

Figure 8A:
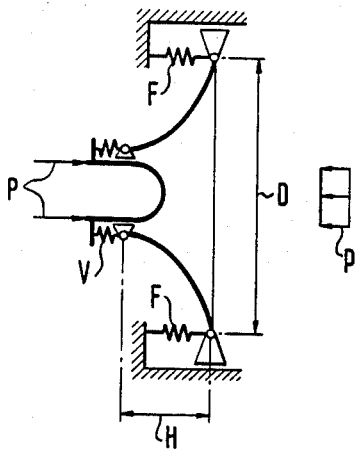
Figure 8B:
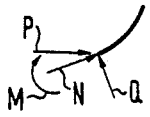
Figure 8C:
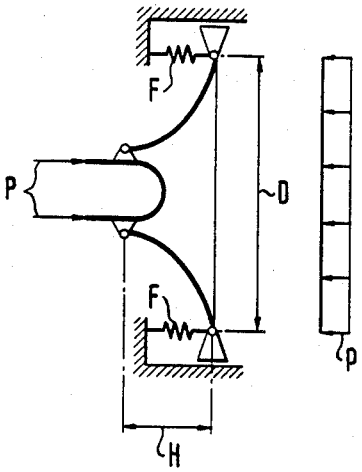
Figure 8D:
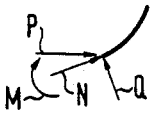

FIG. 8*a* shows the static system of the wide-band loudspeaker according to the invention in the embodiment with NAWI diaphragm under treble frequency load, FIG. 8*b* shows the stress type under treble or high-frequency load, FIG. 8*c* shows the static system of the wide-band loudspeaker according to the invention in the embodiment with NAWI diaphragm under low-frequency or bass load, FIG. 8*d* shows the stress type under bass load.

Figure 1A:
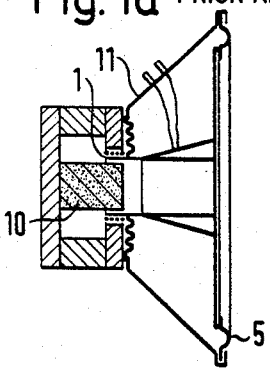
Fig. 1a PRIOR ART
Figure 1B:
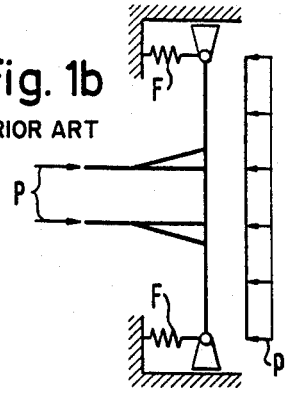
Fig. 1b PRIOR ART
Figure 1C:
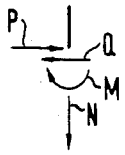
Fig. 1c PRIOR ART
Figure 2A:
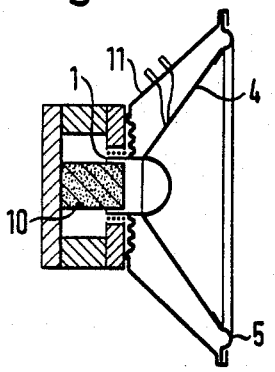
Fig. 2a PRIOR ART
Figure 2B:
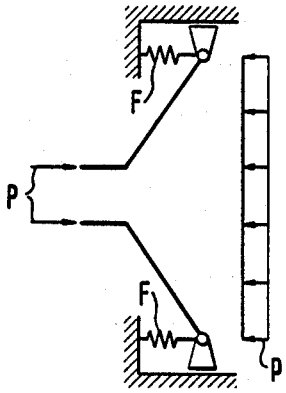
Fig. 2b PRIOR ART
Figure 2C:
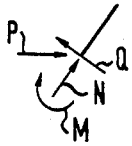
Fig. 2c PRIOR ART
Figure 3A:
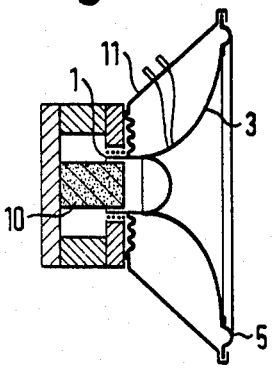
Fig. 3a PRIOR ART
Figure 3B:
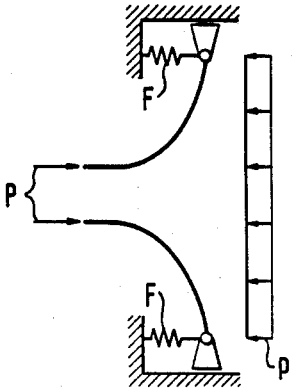
Fig. 3b PRIOR ART
Figure 3C:
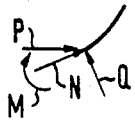
Fig. 3c PRIOR ART
Figure 9:
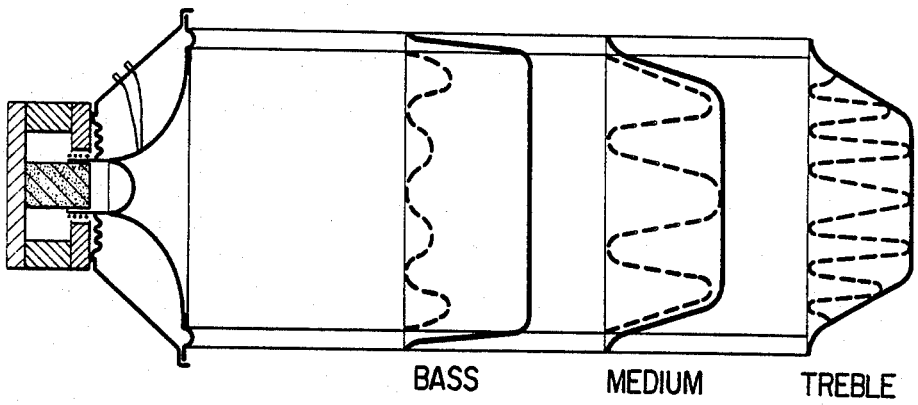
Fig. 9 PRIOR ART

FIG. 9 shows schematically the sound pressure distribution at the diaphragm surface across the cross-section of the diaphragm diameter in a known transducer according to FIG. 3*a* at bass, medium and treble frequencies. In this curve the size and distribution of the fundamental oscillation is shown as full line and the maxima and minima of the partial oscillations as dashed line.

Figure 10:
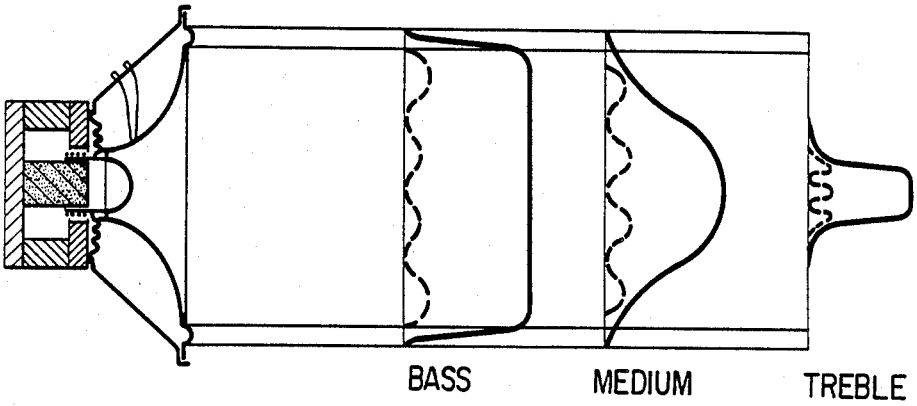

FIG. 10 shows schematically the sound pressure distribution at the diaphragm surface over the cross-section of the diaphragm diameter in the transducer according to the invention of FIG. 7*b* at bass, medium and treble frequencies. In this curve the magnitude and distribution of the fundamental oscillation is shown as full line and the maxima and minima of the partial oscillations as dashed line.

Figure 11:
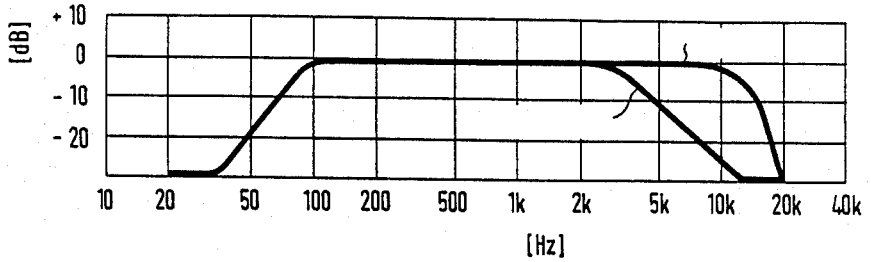
Fig. 11 PRIOR ART

FIG. 11 shows the frequency response measured centrally and 30 degrees eccentrically in a known wide-band loudspeaker according to FIG. 3*a*.

Figure 12:
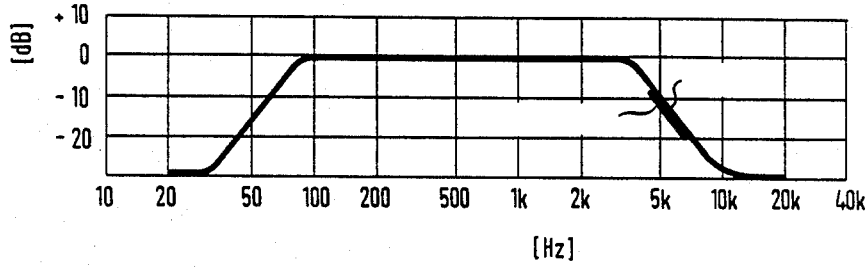

FIG. 12 shows the frequency response measured centrally and 30 degrees eccentrically in a wide-band loudspeaker according to the invention which is otherwise constructed like the loudspeaker giving the curve form of FIG. 11.

Figure 13:
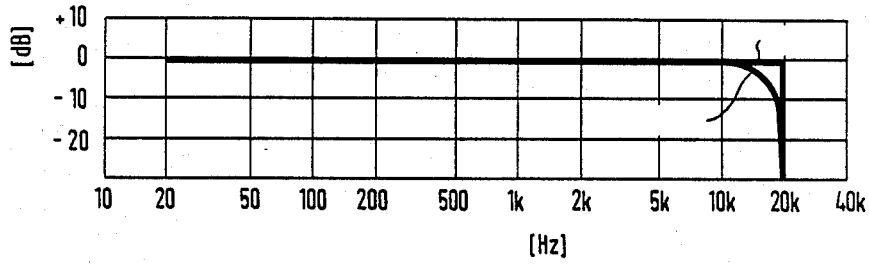

FIG. 13 shows schematically the frequency response measured centrally and 30 degrees eccentrically in a transducer according to the invention of FIG. 7*b* in conjunction with the electronic correction system according to DE-C-3,418,047.

Figure 14:
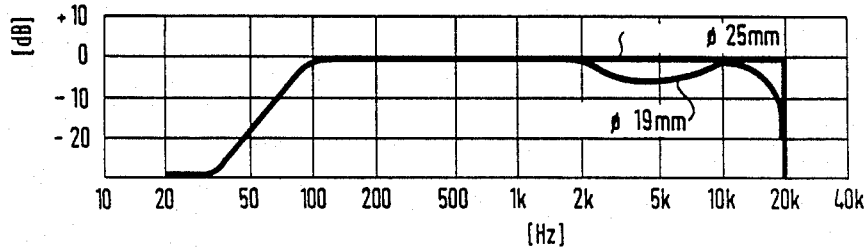

FIG. 14 shows schematically the centrally measured frequency responses of two transducers according to the invention of FIG. 7*b* with identical outer diameters but on the one hand with a moving-coil diameter of 19 mm and on the other with a moving-coil diameter of 25 mm and the corresponding cover dome.

FIG. 15 shows how in the high-frequency range the connection between the outer diaphragm part and moving-coil support deforms.

FIG. 16 shows various embodiments a to k of the connection according to the invention between the outer diaphragm part and the moving-coil support.

In the Figures identical or corresponding known elements or quantities are provided with the same reference numerals. These reference numerals denote:

1 moving-coil support, 2 cover of the moving-coil support, preferably in calotte or dome form, 3 NAWI diaphragm form, 4 cone diaphragm form, 5 edge bead, 7 electrical lead to the moving coil, 8 pole plate, 9 moving coil, 10 magnet, 11 loudspeaker basket, 12 centering spider, 13 three-dimensionally arched shaped or moulded part, 14 three-dimensionally conical shaped or moulded part, P force generated by the moving coil and the excitation current and acting on the moving-coil support, p inertia counteracting the movement, F resilient clamping, N normal force in the cross-section direction, Q transverse force perpendicularly to the cross-section direction, M bending moment perpendicularly to the cross-section direction, SD oscillation damping element, V displaceability through deformation, D outer diaphragm diameter, H spatial overall height of the outer diaphragm part.

FIGS. 7*a* and 7*b* show two halves of loudspeakers schematically each in section through the axis of symmetry and having the connection 6 according to the invention between the moving-coil support 1 and the outer diaphragm part 3 or 4. The outer diaphragm part 4 according to FIG. 7*b* consists of a NAWI diaphragm. The magnet system, the moving-coil support with moving coil, dome or calotte and centering spider as well as the loadspeaker basket are constructed in conventional manner and do not require further explanation.

The connecting or coupling element 6 between the moving-coil support 1 covered by the dome 2 and the outer diaphragm part 3 or 4 consists of a resilient material having a high internal friction. Specific examples of embodiment will be explained hereinafter with reference to FIGS. 16 16. High audio frequencies, which are radiated only via the dome, are practically not transmitted to the outer diaphragm part at all and thus cannot initiate there any partial oscillations. If however under extreme dynamic load partial oscillations are nevertheless stimulated the internal friction of the connecting element 6 acts as damping for said oscillations. The connecting element 6 however also acts as damping for flexural oscillations in the moving-coil support 1 and in the dome 2.

At low frequencies in the bass range the connecting element 6 behaves like a rigid connection between the moving-coil support 1 and the outer diaphragm part 3 or 4. The lower-frequency oscillations are thus completely transmitted by the moving-coil support 1 to the outer diaphragm part 3 or 4 without generating flexural moments.

The connection according to the invention of the moving-coil support to the outer diaphragm part acts like a joint which at high frequencies allows small displacements (FIG. 8*a*) but at low frequencies is not displaceable (FIG. 8*c*). At medium frequencies a frequency-dependent gradual transition takes place between the two extreme conditions.

Analogously to the illustrations in FIGS. 7*a* and 7*b*, FIGS. 7*c* and 7*d* show as further embodiments of the invention two halves of wide-band loudspeakers in section. The embodiments of FIG. 7*c* and FIG. 7*d* have a comparatively long moving-coil support 1 whose transition into the closing dome 2 almost reaches the plane defined by the clamping of the edge bead 5. The connecting element 6 is correspondingly lengthened. The space defined by the outer periphery of the connecting element, the diaphragm and said plane is filled by a shaped or moulded body 13 or 14 which consists of a light but as stiff as possible a material such as foamed polystyrene or a honeycomb structure.

If a small ear probe electret microphone is moved along the surface of the oscillating diaphragm the oscillating behaviour of the overall diaphragm and the distribution of the maxima and minima of the partial oscillations within the oscillating diaphragm can be represented very rapidly and accurately.

This is illustrated in FIG. 9 for a known transducer according to FIG. 3*a* and it can be seen that not only at the low frequencies but also at the medium and high frequencies the sound radiation is distributed over the entire area and the partial oscillations (due to flexural moments) also represent a higher proportion of the sound radiation.

In FIG. 10 this sound pressure distribution is shown for a transducer according to the invention with NAWI diaphragm and this not only gives at low, medium and high frequencies the correct radiation area corresponding to the frequency which avoids the undesirable acoustic directional effects but also greatly reduces the partial oscillations over the entire diaphragm area. This applies accordingly also to the other embodiments of the wide-band loudspeaker according to the invention of FIGS. 7*a, c, d*.

By the connection according to the invention between moving-coil support and the outer diaphragm part only normal forces are introduced into the outer diaphragm part. The diaphragm material itself can excellently process normal forces due to the elasticity modulus and the internal damping.

Moreover, frequency-dependent normal force loads within the diaphragm material are of no significance whereas flexural oscillations in the diaphragm contribute considerably to the acoustic sound radiation and multilate the signal.

In contrast to planar flat wide-band diaphragms which are flexurally stressed from the start and, due to the elasticity modulus of the material and the inertia of the cross-section, must always allow flexural oscillations, with the connection according to the invention only normal forces are introduced into the cross-section of the outer diaphragm part and moreover these forces are effective only up to the point where the introduced energy is destroyed by heat.

Figure 4A:
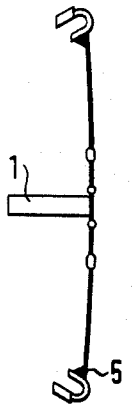
Fig. 4a PRIOR ART
Figure 4B:
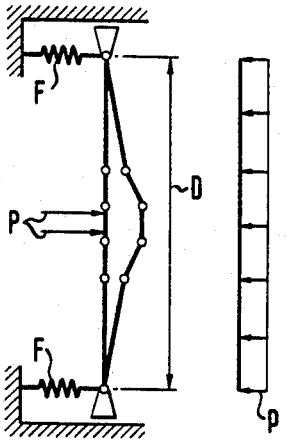
Fig. 4b PRIOR ART
Figure 5:
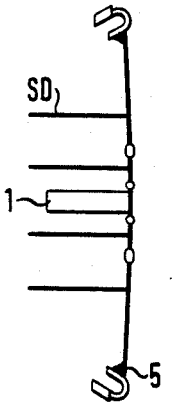
Fig. 5 PRIOR ART
FIG. 5 shows a wide-band loudspeaker according to DE-C-2,927,848.
Figure 6:
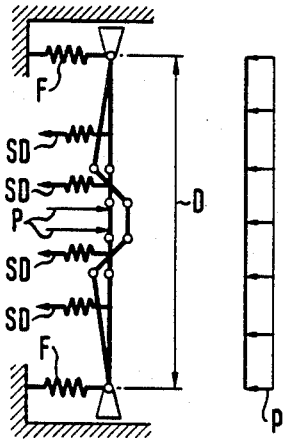
Fig. 6 PRIOR ART
FIG. 6 shows the static system, the load, the deformation and the stress type.

Due to the horn-like shaped form of the outer diaphragm part (illustrated in FIG. 8*a* and FIG. 8*c*) as cone or NAWI diaphragm with overall height H from the lower transition to the moving-coil support and the upper transition over the bead to the loudspeaker basket, a three-dimensional shell or form support structure is obtained which is not sensitive to tilting, in contrast to the planar flat wide-band diaphragm of FIGS. 4*a, b* and FIGS. 5*a,b* of low overall height and high tilt tendency of the diaphragm parts.

The improvements with the connecting of the diaphragm parts according to the invention can also be registered with the usual frequency response measurements 1 m in front of the loudspeaker along the axis and 30° eccentrically. Whereas in a conventional loudspeaker according to FIG. 3*a* the sound pressure differs appreciably with the high frequencies in the centre and eccentrically (FIG. 11) this difference disappears in a loudspeaker which with otherwise identical construction has the connection according to the invention between the moving-coil support and the outer diaphragm part (FIG. 12). Although the sound pressure at high frequencies is reduced in the axis by this step which on superficial observation might be considered to represent a smaller efficiency, on more exact investigation it can be proved that this is only because the partial oscillations in the outer diaphragm part can no longer contribute to the sound radiation and this increases the technical transmission quality and due to the limited radiation area in the high-frequency range the directional effect disappears. When the partial-oscillation-free reduced level in the treble range is compensated by increased electrical power supply the eccentric level also increases to the correct amount and moreover the spatially correct distribution of the acoustic sound energy is obtained.

FIG. 14 shows how by constructional steps such as area changes of the dome cover mounted directly on the moving coil with respect to a constant overall diaphragm diameter the frequency response can be influenced. Whereas the larger dome in the lower high-frequency or treble range is louder and in the upper treble range quieter and again has a somewhat concentrating effect, the smaller dome is quieter in the lower treble range but louder in the upper treble range and also has a lesser tendency to concentrate.

The width and thickness of the compliant or yieldable connection dependent on the frequency in accordance with the invention acts in the treble range as edge clamping V for dome and moving-coil support and in the frequency range therebelow as frequency-dependent transmitter of oscillations to the outer diaphragm part. A compromise should be aimed at between a large thickness of the connection, corresponding to a soft dome clamping which does not become a rigid connection to the outer diaphragm part until very low frequencies, and a small thickness of the connection, which corresponds to a relatively hard dome clamping which even at medium frequencies leads to a fixed connection to the outer diaphragm part. Keeping the thickness constant but increasing the width of the connection between the dome and outer diaphragm part also leads to corresponding changes in the transmission properties. Furthermore, the properties as damper for the partial oscillations in the dome, the outer diaphragm part and in the moving-coil support also depend on the width and thickness of the connection according to the invention. Prestressing of the material can also be taken into account.

If the connection according to the invention between the moving-coil support and the outer diaphragm part were made purely elastic oscillation states dependent on the frequency would arise in which the two diaphragm parts depending on the mass distribution could oscillate in the same phase but also in opposite phase. To avoid this the connection must be designed so that it is yieldable only in the high-frequency range and permits only small deflections of the two diaphragm parts without free displaceability V with respect to each other. At low frequencies the connection must be without displaceability. This can be achieved by the choice of the materials and the constructional form of the connection.

An electronic correction system according to DE-C-3,418,047 can also contribute to the desired mode of operation of the connection. The increased electrical power supply for example in the treble range can supply the deformation energy necessary for small deflections V. However, this energy is not conducted by the design of the connection according to the invention into the outer diaphragm part but is processed within the connection and converted to heat. This increased energy supply drops very rapidly even in the medium-frequency range and in the bass range is no longer effective.

All the constructional steps such as changing the stiffness of the elastic edge clamping of the outer diaphragm part to the loudspeaker basket, the connection according to the invention between the outer diaphragm part and the moving-coil support, and the total stiffness of the outer diaphragm part and its weight represent constructional means for equalization of the wide-band loudspeaker which should be utilized as far as possible to obtain a linear frequency response.

The connection according to the invention is intended to introduce predominantly normal forces from the moving-coil support as normal forces to the outer diaphragm part. For the connection according to the invention the normal forces from the moving-coil support act as transverse force for shearing stressing. This shear stressing (FIG. 15) is more resistant over long periods of time to a tensile or compressive stressing.

Preferably, a connection of rectangular cross-section should be used which is either secured directly to the moving-coil support or to a heat-insulating layer which in turn is secured to the heat-conducting moving-coil support. The connection can additionally be fixedly adhered to the outer diaphragm part or even vulcanised on. FIG. 16 shows a number of possibilities for the construction of the connecting element 6. As an alternative the connection can be applied over the moving-coil support already greatly prestressed to avoid resonances even more effectively by the application pressure. It is also possible to clamp over the lower edge of the outer diaphragm part a resilient or elastic band to press the diaphragm against the connection according to the invention (FIG. 16). Other embodiments instead of rectangular cross-sections are also possible, for example round or oval cross-sections or a tongue and groove connection. The connection can also be made in one piece or in two separate pieces, and the separate pieces can also be formed for different characteristics, for example optimum normal force transmission and optimum oscillation damping. The connection can be stuck on or also pulled on. Likewise, adhesive compositions which remain yieldable can be used to establish the connection according to the invention.

Possible materials for the connection according to the invention are rubber, neoprenes, PVC, silicone or similar elastomers. The resilient and the damping properties of the elastomers are defined in their fundamental behaviour by the molecular structure but can be additionally further optimized by the degree of crosslinking of the molecules and by the nature and amount of the fillers and reinforcing agents. Well suited because of their high damping are for example inter alia epichlorhydrin rubber (ECO), polynorbornene rubber (PNR), polyacrylate rubber (ACM) and butyl rubber (IIR). Average degrees of crosslinking of the molecular chains have proved advantageous. Good fillers and reinforcing agents for damping which also ensure constant physical behaviour even over wide temperature ranges are for example graphite or quartz powder. It is also possible to use mixed products with partial elastic partially plastic material with or without reinforcement by fibres, and equally possible to use hoses with plastically formable content. Balsa wood or foam materials also have the property of absorbing high-frequency oscillations well and further conducting low-frequency oscillations without losses. Material can be used which in all three axes has the same characteristics or different characteristics for expansion, stiffness, deformability and damping.

The connection of the moving-coil support to the dome-shaped cover should be made fixed and rigid and the dome itself preferably made from metal for better heat dissipation. The adhesive between the dome and moving-coil support also preferably has a good thermal conductivity.

The outer diaphragm part can be round or oval at the outer edge but the transition to the moving-coil support at the inner edge is round.

I claim:

1. A wide-band loudspeaker comprising:

a diaphragm area divided into at least two sub-areas, including an inner diaphragm sub-area and an outer diaphragm sub-area, each of said diaphragm sub-areas being optimized for the production of a different portion of an audio frequency range;

wherein said inner diaphragm sub-area includes a moving-coil cover connected to a moving-coil support;

wherein said outer diaphragm sub-area is coupled to an inner diaphragm sub-area by a connection means which has a frequency dependent modulus of elasticity so that said outer diaphragm sub-area remains substantially at rest when said loudspeaker is generating high frequency audio signals and so that said outer diaphragm sub-area moves substantially in unison with said inner diaphragm sub-area when said loudspeaker is generating low frequency audio signals;

wherein when said loudspeaker is generating intermediate frequency audio signals, movement of said outer diaphragm sub-area is partially responsive to movement of said inner diaphragm sub-area via said connection means, said connection means dissipating, by internal friction, a portion of the mechanical energy received from said inner diaphragm sub-area, wherein said outer diaphragm sub-area is constructed in a form selected from a group consisting of a cone diaphragm, a NAWI diaphragm, a shaped body, and a molded body;

wherein said selected form is planar at the front and rear boundary thereof; and wherein said outer diaphragm sub-area is of a sufficient height that said selected form is stressed by a force normal thereto, but is substantially unstressed by flexing or tilting forces.

2. The loudspeaker of claim 1 wherein said moving-coil cover is dome shaped.

3. The loudspeaker of claim 1 wherein said connection means is comprised of a homogeneous material.

4. The loudspeaker of claim 1 wherein said connection means is comprised of at least two materials, each of said two materials having a different modulus of elasticity.

5. The loudspeaker of claim 1 wherein said connection means has different frequency-dependent characteristics in each of three orthogonal axes.

6. The loudspeaker of claims 2, 3 or 4, wherein said connection means is mounted prestressed on said moving coil support.

7. The loudspeaker according to claims 3, 4 or 5 wherein said connection means is pressed by said outer diaphragm sub-area onto said moving coil support.

8. The loudspeaker according to claim 1 wherein said selected form is a cone diaphragm.

9. The loudspeaker according to claim 1 wherein said selected form is a NAWI diaphragm.

* * * * *

UNITED STATES PATENT AND TRADEMARK OFFICE

CERTIFICATE OF CORRECTION

PATENT NO. : 4,821,330

DATED : April 11, 1989

INVENTOR(S) : Peter Pfleiderer

It is certified that error appears in the above-identified patent and that said Letters Patent is hereby corrected as shown below:

Column 5, line 43, change "k" to -- j --.
Column 6, line 3, Insert the following -- according to Fig. 7a consists of a cone diaphragm and the outer diaphragm part 3 -- .
Column 6, line 13, delete "16" second instance.
Column 10, line 4, after "area" insert a -- , --.
lines 4 and 5 delete "and" through "sub-area".
line 31 "a" before "NAWI" should read --an --.
line 33, after "front" insert a -- , --.
line 34, before "rear" should read -- the --.
Column 10, line 34, between the word "thereof" and the semi-coln; insert the phrase -- has the form of a cone or a NAWI diaphragm --.

Signed and Sealed this

Twenty-fifth Day of February, 1992

*Attest:*

*Attesting Officer*

HARRY F. MANBECK, JR.

*Commissioner of Patents and Trademarks*